United States Patent [19]

Willis et al.

[11] Patent Number: 4,726,192

[45] Date of Patent: Feb. 23, 1988

[54] DUAL FUEL INJECTORS

[75] Inventors: Jeffrey D. Willis; Ian M. Waddell, both of Coventry, England

[73] Assignee: Rolls-Royce plc, London, England

[21] Appl. No.: 73,850

[22] Filed: Jul. 14, 1987

Related U.S. Application Data

[63] Continuation of Ser. No. 857,233, Apr. 29, 1986, abandoned.

[30] Foreign Application Priority Data

Jun. 7, 1985 [GB] United Kingdom ..... 8514479

[51] Int. Cl.[4] ..... F02C 1/00

[52] U.S. Cl. ..... 60/737; 60/748; 60/743

[58] Field of Search ..... 60/39.31, 39.141, 742, 60/749, 734, 737, 738, 748

[56] References Cited

U.S. PATENT DOCUMENTS

| | | | |
|---|---|---|---|
| 2,635,425 | 4/1953 | Thorpe et al. | 60/742 |
| 3,013,732 | 12/1961 | Webster et al. | 60/742 |
| 3,691,765 | 9/1972 | Carlisle | 60/742 |
| 3,788,067 | 1/1974 | Carlisle et al. | 60/742 |

*Primary Examiner*—Louis J. Casaregola
*Assistant Examiner*—Timothy S. Thorpe
*Attorney, Agent, or Firm*—Cushman, Darby & Cushman

[57] ABSTRACT

A dual fuel injector for a gas turbine power plant has fuel ducting including gas and liquid fuel ducts which can be removed easily for access to a nozzle of the fuel duct. A separate fluid ducting assembly is attached in the head of each combustor can and has an annular duct, a passage and drillings. The power plant is started on liquid fuel, and runs subsequently on gas produced in a coal gasifier. The flow of air through the duct and passage prevents any unburnt fuel or combustion products from entering the gas duct, and the flow through the drillings prevents carbon build up on face of the injector.

1 Claim, 4 Drawing Figures

LIQUID FUEL OPERATION

LIQUID FUEL OPERATION

GAS FUEL OPERATION

DUAL FUEL INJECTORS

This is a continuation of application Ser. No. 857,233, filed Apr. 29, 1986, which was abandoned upon the filing hereof.

This invention relates to a dual fuel injector for a gas turbine engine which is adapted for use as an industrial power plant, e.g., to generate electricity.

The invention is particularly, but not exclusively concerned with a dual fuel injector for a remotely located gas turbine power plant which is designed to operate principally on a gaseous fuel produced in a coal, gasifier, the coal gasifier being provided with air derived from the power plant. The gaseous fuel produced by the coal gasifier is of a medium calorific value and is not a available fuel for starting the power plant. An available fuel for this latter purpose, particularly in a remote location, is a diesel fuel, which can be stored easily.

There are two main problems involved in the design of such a duel fuel injector, these being: considerable modification to the existing combustion system, and difficulty in removing the liquid fuel part of the injector which requires frequent overhaul due to the liquid orifices being prone to blockage.

The present invention seeks to provide a dual fuel injector in which both of these problems are overcome.

Further, the present invention seeks to provide a dual fuel injector in which the injector is purged during operation to prevent combustion products and fuel from entering the gas fuel flow paths, and to prevent carbon accretion on the injector.

Also, the gas fuel is used both to cool the liquid fuel part of the injector, and to prevent carbon accretion on the injector.

Accordingly, the present invention provides a dual fuel injector for a gas turbine engine power plant, the injector including fuel ducting adapted to be secured to a casing of the power plant, and a fluid ducting assembly adapted to be secured to combustion apparatus of the power plant, the fuel ducting including an outer gas fuel duct in which is located a liquid fuel duct terminating in at least one nozzle, the fluid ducting comprising outer and inner members, the inner member being supported from the outer member, the members defining between them an annular open ended fluid duct adapted to receive either air from a compressor of the power plant or gaseous fuel, the inner member also forming an open ended duct adapted to receive the terminal portion of the liquid fuel nozzle, and to permit the through flow of either air from the said compressor or gaseous fuel, the inner member terminating in a bluff surface having apertures allowing the through flow of either air from the said compressor or gaseous fuel from the interior to the exterior of the inner member.

Figure 1:
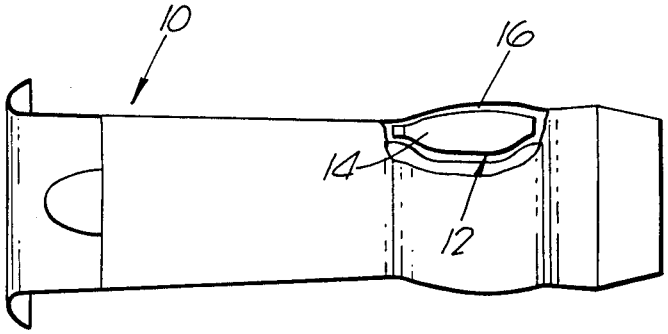
Figure 2:
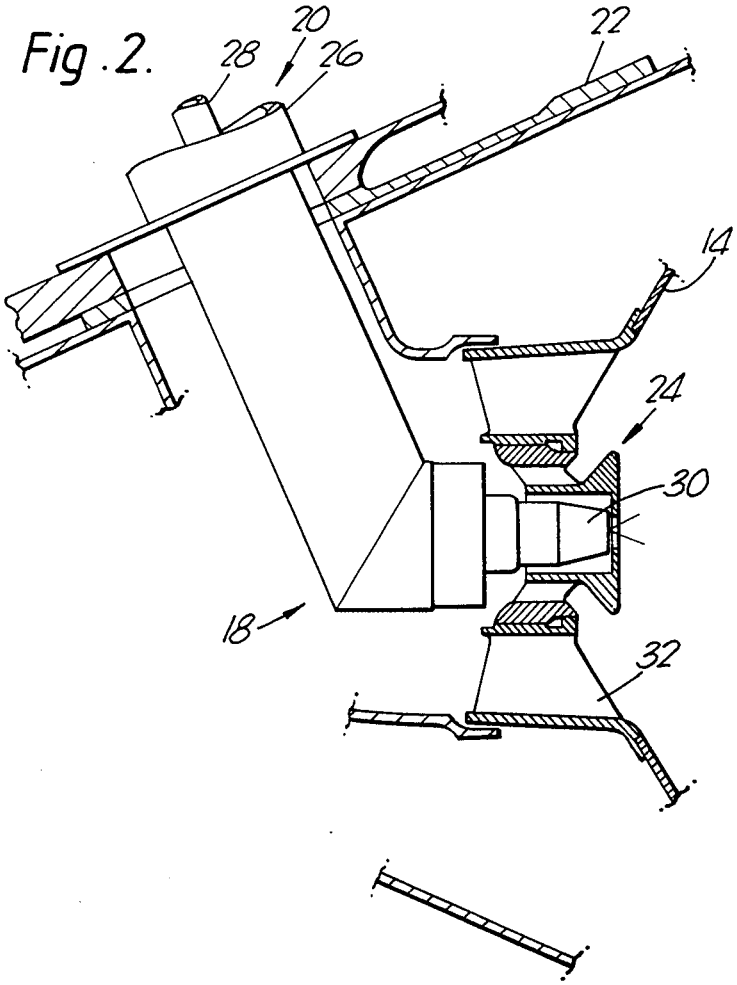
Figure 3:
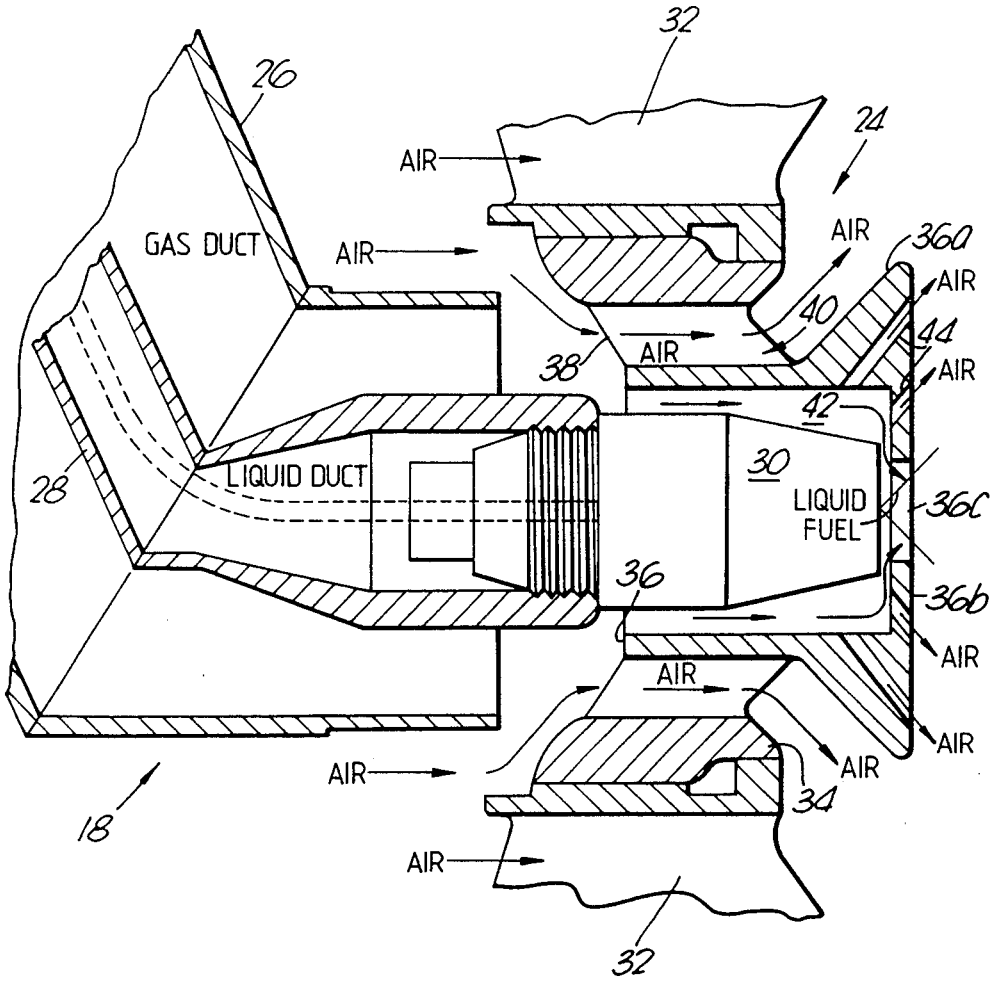
Figure 4:
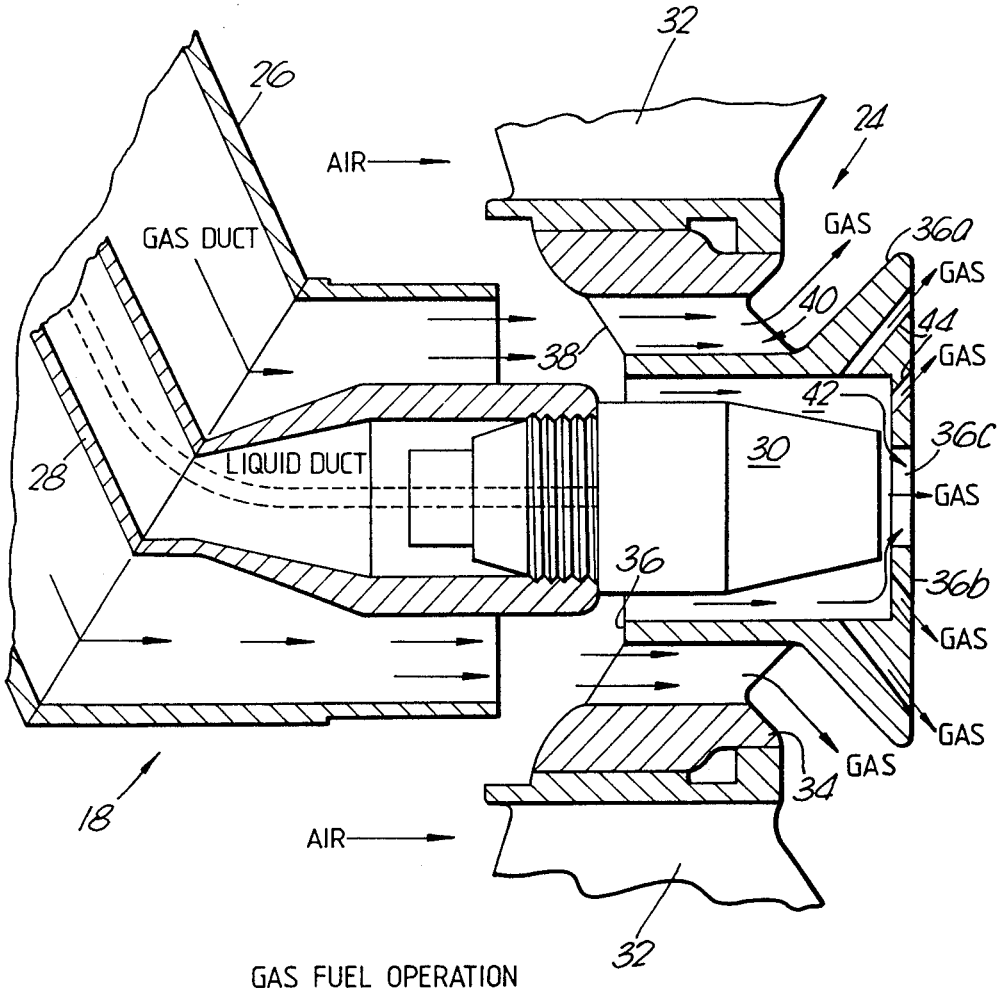

The present invention will now be more particularly described with reference to the accompanying drawings in which, FIG. 1 shows in diagrammatic form part of a gas turbine engine power plant, incorporating invention, FIG. 2 one embodiment of a dual fuel injector according to the present invention, FIG. 3 shows in more detail, the dual fuel injector of FIG. 2 when operating on liquid fuel, and FIG. 4 shows the dual fuel injector of FIG. 2 when operating on gas fuel.

Referring to the drawings, a gas turbine engine power plant includes a gas generator 10, a power turbine (not shown) and a load, such as an AC generator (not shown), driven by the power turbine. The gas generator includes a compressor, a combustion apparatus 12, and a turbine driving the compressor. The combustion apparatus includes a number of combustor cans 14 located in an annular casing 16, each can 14 having a dual fuel injector 18 (FIG. 2). The engine is adapted to operate on a gas fuel produced by a coal gasifier (not shown), the source of air for which is derived from the compressor of the gas generator. For starting purposes, the engine is adapted to operate on a liquid fuel of the diesel type, drawn from a tank (not shown).

Referring more particularly to FIG. 2, the injector 18 is divided into two principal parts, a fuel injector ducting 20 secured to a casing 22 of the gas generator, and a fluid ducting assembly 24 secured in the head of each combustor can 14.

The fuel injector ducting 20 comprises an outer gas fuel duct 26 in which is located a liquid fuel duct 28 which serves as fuel ducting means and which terminates in a liquid fluid nozzle 30. The downstream end of the fuel duct 26 terminates downstream of the liquid fuel nozzle 30 while the downstream end of the liquid fuel nozzle 30 terminates a short distance from the bluff face 36B.

The fluid ducting assembly 24 is located within a ring of swirl vanes 32 secured within the head of each combustor can 14. The assembly 24, which serves as a fluid ducting means, comprises an outer member 34 (see FIG. 3) and an inner member 36 secured to the outer member by a number of equi-spaced radial struts 38. The members 34, 36 define between them an annular open ended passage 40 for the through flow of air from the power plant compressor or gas fuel from the gasifier. Within the inner member 36 there is provided an annular duct about the liquid fuel nozzle 30 which defines an annular cavity having a peripheral wall completely surrounding the downstream end of the fuel nozzle 30 and which is spaced outwardly therefrom to provide a fluid passage over the surface of the liquid fuel nozzle 30.

The inner member 36 is also open ended and has a flared downstream end **36*a* and a bluff downstream face 36*b*. The flared end directs the air or gas fuel in the duct 40 into the combustor can in the required direction. The nozzle 30 of the liquid fuel duct is positioned within the member 36 and is aligned with an opening 36*c* in the bluff face 36*b*. A space 42 between the liquid fluid nozzle 30 and the member 36** provides a passage for the throughflow of air or gas fuel.

Drillings or apertures 44 are made through the bluff surface **36*b* so that air or gas fuel can flow over the face. When the power plant is to be started, liquid fuel (see FIG. 3) is supplied through the duct 28 to each liquid fluid nozzle 30**, and air is supplied from the compressor of the gas generator.

The air flows through the swirl vanes 32, the duct 40, the passage 42, and the drillings 44, whilst the liquid fuel is injected into the combustor first aperture or through opening **36*c*. The fuel mixes with the air and is ignited by an igniter (not shown). The air flow through duct 40 and passage 42 prevents any unburnt fuel or combustion products from flowing back into the gas duct 26. The air flowing through the drilling 44 prevents build-up of carbon on the face 36*b***.

Once the gas generator is self-sustaining and the coal derived gas fuel becomes available the liquid fuel supply is cut-off, and gas fuel is supplied to the duct 26 (see FIG. 4). Air continues to flow through the swirl vanes 32 but the duct 40, passage 42 and the drillings 44 are filled with gas fuel.

The flow of gas fuel over the liquid fuel nozzle 30 keeps this part of the liquid fuel feed relatively cool, and the flow through the drillings prevents carbon accretion on the face 36*b*.

The fuel injector ducting 20 can be removed easily from the gas generator casing, so that access to the liquid fluid nozzle 30 is quite simple. This liquid fluid nozzle is prone to blockage so that cleaning or replacement has to be done relatively frequently. For ease of replacement, the liquid fluid nozzle 30 is screwed to the end of the duct 28.

The fluid ducting assembly can be fitted readily within the existing ring of swirl vanes so that modifications to the gas generator are relatively minor in nature.

We claim:

1. A dual fuel injector for a gas turbine engine power plant comprising at least a casing, combustion apparatus and a source of air, said dual fuel injector comprising:

fuel ducting means detachably secured to said casing;

fluid ducting means secured to said combustion apparatus;

said fuel ducting means including a gas fuel duct having a downstream end, a liquid fuel duct positioned within said gas fuel duct and having a downstream end, and a liquid fuel nozzle detachably secured to said downstream end of said liquid fuel duct at a position downstream of said downstream end of said gas fuel duct so that said liquid fuel nozzle projects beyond said downstream end of said gas fuel duct, said liquid fuel nozzle having a downstream end portion and a fuel outlet at said downstream end portion;

means securing said fluid ducting means to said combustion apparatus so that said fluid ducting means surrounds at least said liquid fuel nozzle and is disposed downstream of said downstream end of said gas fuel duct;

said fluid ducting means comprising an outer member and an inner member, said inner member being supported from said outer member, said inner member having an interior defining an annular cavity having a peripheral wall completely surrounding the downstream end of said liquid fuel nozzle and spaced outwardly therefrom to provide a fluid passage over the surface of said liquid fuel nozzle for receiving flow of air and gaseous fuel, said inner member terminating in a downstream end defining a bluff surface, said bluff surface being spaced apart from said liquid fuel nozzle and having a first aperture aligned with said outlet of said liquid fuel nozzle and a plurality of apertures for exhausting gas and air from said space between said downstream end portion of said liquid fuel nozzle and said inner member.

* * * * *